US009044626B2

(12) United States Patent
Truex et al.

(10) Patent No.: US 9,044,626 B2
(45) Date of Patent: Jun. 2, 2015

(54) REMAINING SERVICE LIFE INDICATION SYSTEM FOR GAS MASKS CARTRIDGES AND CANISTERS

(71) Applicant: Nextteq, LLC, Tampa, FL (US)

(72) Inventors: Bryan I. Truex, Tampa, FL (US); Gueorgui M. Mihaylov, Virginia Beach, VA (US)

(73) Assignee: NEXTTEQ, LLC, Tampa, FL (US)

( * ) Notice: Subject to any disclaimer, the term of this patent is extended or adjusted under 35 U.S.C. 154(b) by 0 days.

(21) Appl. No.: 14/297,129

(22) Filed: Jun. 5, 2014

(65) Prior Publication Data

US 2014/0283840 A1 Sep. 25, 2014

Related U.S. Application Data

(62) Division of application No. 13/227,288, filed on Sep. 7, 2011, now abandoned.

(60) Provisional application No. 61/380,604, filed on Sep. 7, 2010.

(51) Int. Cl.

| | |
|---|---|
| ***A62B 18/08*** | (2006.01) |
| ***A62B 18/02*** | (2006.01) |
| ***A62B 9/00*** | (2006.01) |
| ***A62B 19/00*** | (2006.01) |
| ***A62B 23/02*** | (2006.01) |
| ***A62B 27/00*** | (2006.01) |

(52) U.S. Cl.

CPC ..... *A62B 18/02* (2013.01); *A62B 9/006* (2013.01); *A62B 18/088* (2013.01); *A62B 19/00* (2013.01); *A62B 23/025* (2013.01); *A62B 27/00* (2013.01)

(58) Field of Classification Search

CPC ..... A62B 18/02; A62B 18/088; A62B 19/00; A62B 23/025; A62B 27/00; A62B 9/006

See application file for complete search history.

(56) References Cited

U.S. PATENT DOCUMENTS

| | | | | |
|---|---|---|---|---|
| 4,994,117 | A * | 2/1991 | Fehder | 436/133 |
| 5,666,949 | A | 9/1997 | Debe et al. | |
| 5,861,053 | A * | 1/1999 | Noritake et al. | 96/111 |
| 6,626,355 | B2 * | 9/2003 | Sasse et al. | 235/375 |
| 7,309,513 | B2 * | 12/2007 | Brey et al. | 427/212 |
| 7,424,889 | B2 * | 9/2008 | Mashak | 128/205.28 |
| 8,210,178 | B2 * | 7/2012 | Schermeier et al. | 128/205.28 |
| 2004/0182392 | A1 * | 9/2004 | Gerder et al. | 128/204.22 |
| 2004/0223876 | A1 | 11/2004 | Kirollos et al. | |
| 2005/0030160 | A1 * | 2/2005 | Goren et al. | 340/10.5 |
| 2005/0211761 | A1 * | 9/2005 | Anttila et al. | 235/376 |
| 2005/0268916 | A1 | 12/2005 | Mumford et al. | |
| 2006/0096454 | A1 * | 5/2006 | Farant et al. | 95/148 |
| 2006/0254427 | A1 * | 11/2006 | Trend et al. | 96/154 |
| 2006/0278220 | A1 | 12/2006 | Schermeier et al. | |

(Continued)

*Primary Examiner* — Christopher P Jones

(74) *Attorney, Agent, or Firm* — Bernard G. Pike; Pike IP Law, PLLC

(57) ABSTRACT

Gas masks and canisters for gas masks have a chemical sorbent that protects the respiratory system of the wearer from gaseous compounds. The remaining service indication systems for respiratory protections systems provide a warning to the wearer that the capacity of the chemical sorbent to adsorb or absorb further compounds is nearly depleted. A remaining service life indication system has a computer memory device for storing information concerning the canister for determining an end of the service life of a gas mask, a canister and/or a cartridge and such devices from the input of various sensors.

17 Claims, 6 Drawing Sheets

(56) References Cited

U.S. PATENT DOCUMENTS

| | | | | |
|---|---|---|---|---|
| 2008/0004743 | A1 | 1/2008 | Goers et al. | |
| 2008/0053193 | A1* | 3/2008 | Ahmad | 73/25.01 |
| 2008/0053439 | A1* | 3/2008 | Lighton | 128/204.22 |
| 2008/0156192 | A1* | 7/2008 | Sinclair et al. | 96/5 |
| 2008/0308100 | A1 | 12/2008 | Pujols et al. | |
| 2009/0211453 | A1* | 8/2009 | Nassivera et al. | 96/153 |
| 2009/0311144 | A1* | 12/2009 | Kim et al. | 422/119 |
| 2010/0139657 | A1* | 6/2010 | Chalvignac et al. | 128/204.22 |
| 2012/0055474 | A1* | 3/2012 | Wilkinson | 128/204.21 |

* cited by examiner

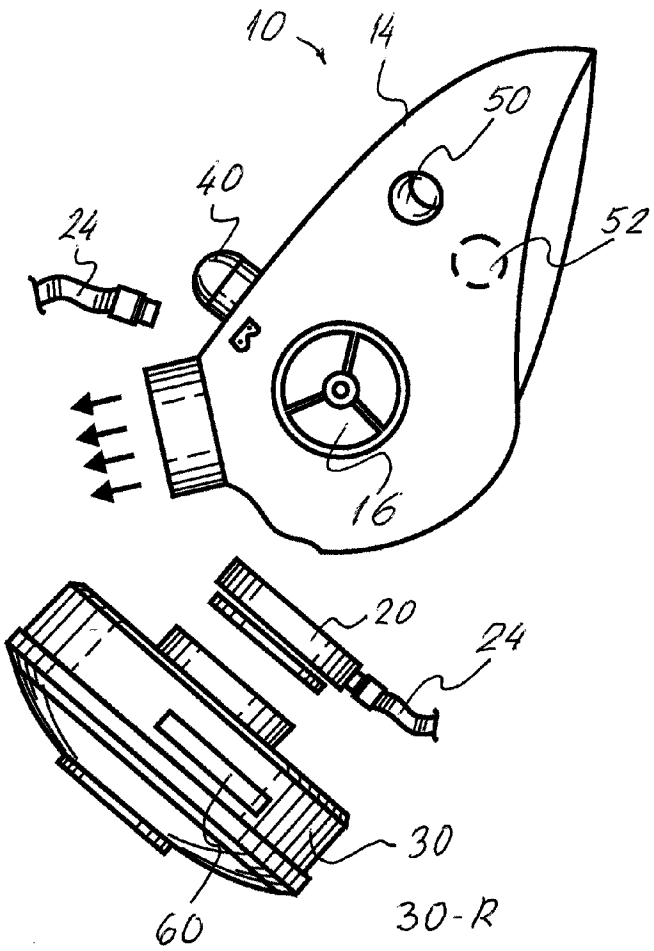
Fig. 1 - B
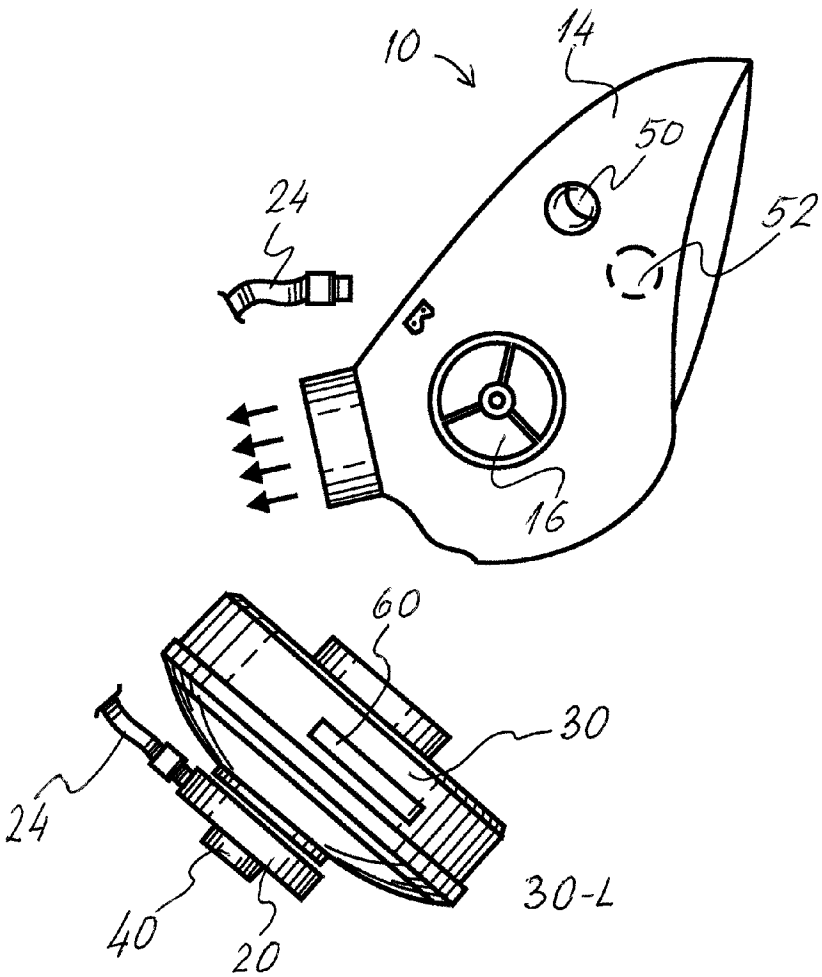
Fig. 1 - A

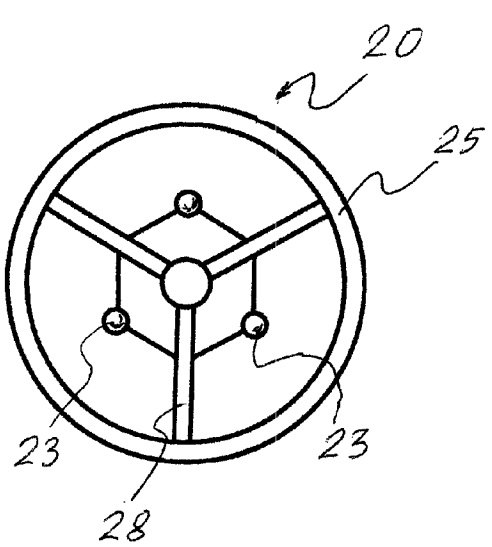
Fig. 4 - B
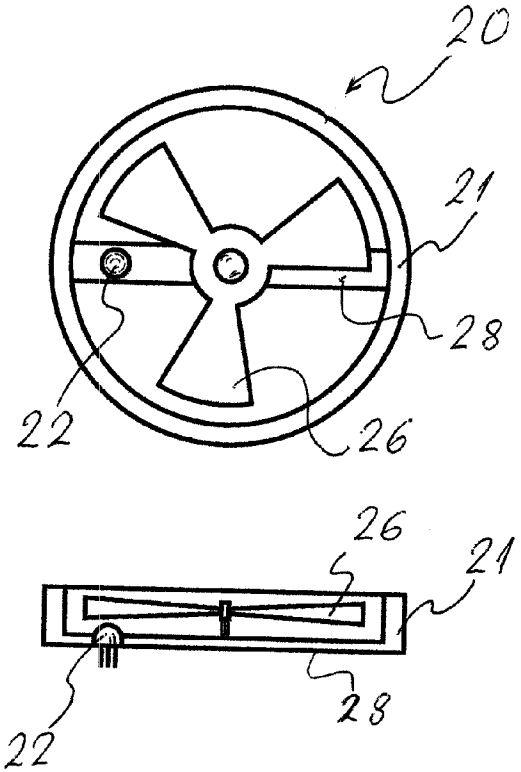
Fig. 4 - A
Fig. 4

REMAINING SERVICE LIFE INDICATION SYSTEM FOR GAS MASKS CARTRIDGES AND CANISTERS

RELATED PATENT APPLICATIONS

This patent application claims priority 35 U.S.C. §120 to U.S. patent application Ser. No. 13/227,288 filed on Sep. 7, 2011 under 35 U.S.C. §119 to U.S. Provisional Patent Application No. 61/380,604 filed on Sep. 7, 2010 which are both hereby incorporated by reference in their entirety.

FIELD OF THE INVENTION

The invention relates to respiratory protection systems including gas masks and canisters for gas masks. Embodiments include remaining service life indicators or remaining service indication systems for respiratory protections systems, a gas mask comprising a remaining service life indication system, and canisters comprising a computer memory device for storing information concerning the canister. Embodiments further include methods of determining the end of end of service life of a gas mask, a canister and/or a cartridge and such devices.

BACKGROUND

Gas masks, respirators or other respiratory protection systems using permanent or replaceable cartridges and/or canisters are commonly used for protection against a variety of airborne pollutants. Respirator cartridges/canisters usually contain one particulate filter for toxic or nontoxic materials ("particulate filter") and a sorption media for adsorption or absorption of gases and vapor content in the atmosphere. While these devices provide excellent protection against hazardous materials, there capacity to provide protection is limited and may be depleted with use, exposure to chemicals, or fouling. Therefore, for the cartridge and/or canister to provide effective of protection of the user the cartridge/canister must be replaced prior to the end of its service life.

The cartridges/canisters should be changed prior to the end of their operational life span. However, predicting the life span of the filter cartridges/canisters is complicated task. The sorption capacity of the sorbent is dependent on parameters such as relative humidity, ambient temperature, the concentration and specific properties of the contaminant(s) absorbed by the sorption media and the volume and rate of air passing through the cartridge/canister.

Contemporary safety practice requires all gas respirators to have a reliable method for indication of the end of their service life. If a direct measurement method is not practical, a schedule of cartridge use and replacement thereby tracking the exposure should be implemented. The use of replacement schedules, even most advanced ones, requires reliance on historical monitoring of the working environment, estimation of the average total exposure and approximation of the results according to measured or predicted theoretical capacity of the cartridge under certain circumstances. Not only do the surrounding environmental conditions contribute to the total load on the sorption media of the respirator, but also the volume of air that has passed through the media needs to be determined to calculate the load and the end of service life of the cartridge/canister. The respiration capacity of the different users and the changes of this capacity under different environmental and (light or heavy) working condition could lead to big (up to 3-4 folds) differences in the total load in the same well monitored environmental conditions. The cartridge of one worker may reach its end of service life more quickly than another worker even under the same environmental conditions. Further, the same person performing the same work under different temperature and humidity levels may show sufficient differences in respired volume. To track many cartridges under different conditions, times and working places is very complicated and sometime even impossible task. These are considered to be drawbacks of the accepted scheduling methods for determining end of service life. Therefore, a variety of methods and devices attempting to provide real monitoring and end of service life estimating using the exposure concentration, exposure time and total air flow through the sorbent have been developed.

There are a variety of methods and devices designed to indicate the depletion or end of service life of the sorption layer (sorption bed) in the gas canisters/cartridges for respirators. Depletion of the sorption layer is dependent on the industrially generated different volatiles (organic or inorganic) in the air which must be cleaned up according to required safety standards. The vapor pressure of the volatile's varying in very big range and their ability to get sorbed on the sorption bed is inversely proportional to the volatility—the less volatile substance with small vapor pressure has better sorption and the sorbent shows higher capacity to them. As the sorption capacity for a particular substance defines the moment of breakthrough, for every substance this moment is different, therefore real time monitoring of the depletion of the sorbent is preferred.

One direct method involves sensors with a change of the color of sorbent along the sorption bed (BG Pat. 31666 to Mihaylov) or color change in the indicating material placed along the sorbent bed inside of transparent wall "of additional indicating cartridge in flow after the main filter cartridge" Australia Pat. WO9,512,432 or on the wall inside of the filter cartridge U.S. Pat. No. 6,497,756 B1 and U.S. Pat. No. 4,326,514. Such material indicates irreversible changes in the sorption bed after being saturated by certain dangerous material. Drawbacks of these types of sensors are their narrow specificity which limits their use to specific needs and well known situations for expected substances and gas mixtures, mainly for inorganic gases and vapors as in U.S. Pat. No. 4,326,514; U.S. Pat. No. 4,873,970, U.S. Pat. No. 5,323,774 and U.S. Pat. No. 6,497,756.

Leichnitz in U.S. Pat. No. 4,684,380 teaches a colorimetric sensor for toxic gases. The sensing element comprises a granulated material, similar to one used in detector tubes, immobilized between two screens and is transparent to the gas flow. The placement of such sensor on the back of the sorption layer is observable through a lens in the back of the cartridge. A similar colorimetric approach is used in U.S. Pat. No. 5,297,544 where array of indicator means with a plurality of indicating ranges are used. They are forming chip-like support element with indicating colorimetric indicator portions exposed to air being inhaled. Such means are situated between outer full piece mask and inner half-mask. The indicator different ranges are used for visual examination or optical evaluation with appropriate means. In U.S. Pat. No. 5,666,949 such colorimetric sensors are combined with an electronic reading system. Despite the electronic reading system, the sensor is actually a colorimetric one. The drawbacks of the colorimetric sensors are defined by their (before mentioned) specificity. The colorimetric type sensors are humidity (RH) and temperature (T) dependent which are important parameters for all chemical colorimetric reactions.

Another direction of real time end of service life indicator is using electronic temperature sensor situated immediately after the sorption bed as in U.S. Pat. No. 4,440,162 to Sewel at all. This sensor, however, is limited and usable only for substances presented at high concentration and having a large temperature effect when absorbed on the sorption media. These sensors are, therefore, not widely applicable. Saturation process at low concentration for long period of time can cause breakthrough and pass undetected.

Recent approach for end-of-service-life indication are some active type ESLI's. They comprise electronic components to monitor the level of contaminants and a visual or audible signal to provide an automated warning to the user. Some historical attempts are described in U.S. Pat. No. 3,902,485; U.S. Pat. No. 3,911,413, both never been implemented because of bulkiness, high cost and low sensitivity. In 1978 NIOSH selected a metal oxide sensor (MOGS) to act as service life indicator for organic vapor air purifying respirators. This sensor was chosen on the basis of low cost, commercial availability and its desirable non specific behavior to large variety of organic vapors. The main drawback of MOGS is the large current drain caused by relatively high operational temperature (~200 C). Two patents, U.S. Pat. No. 4,873,970 and U.S. Pat. No. 4,847,594, describe a standard electrochemical measuring cell. The proposed warning cartridge was designed to fit in between the facemask and respirator cartridge. A drawback of this design is that toxic gases could only be detected once the breakthrough already occurs, therefore the system may not comply with NIOSH recommendation for adequate warning 20-25% before 100% of the cartridge is depleted. U.S. Pat. No. 5,512,882 advantageously suggest a generic sensor inside of the cartridge adsorbent. Similar approach had U.S. Pat. No. 5,018,518. U.S. Pat. No. 5,297,544 is teaching the indicator that simultaneously registered the retention effect of the filter and the sealing effect of the edge of the mask. Furthermore this patent proposed the use of a miniaturized computer chip-like indicator system capable of detecting pollutants at different levels. The indicator system itself was anticipated to consist of a light source and detector. The light intensity, measured as reflected or transmitted light, was a measure of the amount of pollutant received by the indicator. U.S. Pat. No. 5,659,296 describe a contemporary but still cumbersome system using electronic device attached to the side of the respirator. Air passed through the sorbent material was constantly sampled and processed to give an active indication—with visual, audio, tactile response to the concentration signal. The signaling rate of the indicator varied as a function of target species concentration. The drawback of described system is again placement of the proposed sensors directly behind the respirator cartridge which is after 100% depletion to allow time for safety replacement of the cartridge. The drawbacks of most proposed systems are also high energy consumption and cumbersome equipment.

Conventional solutions suffer from many drawbacks such as:

The described electronic or optic-electronic devices are complicated and bulky, difficult to maintain and even to manufacture and use at contemporary level of technology of sensors.

The ultimate cost is so high that the cost eradicates the purpose of their use as money saving unit as compared to just replacing canisters and cartridges on a schedules for timely change. In order to provide secure buffer capacity of 20-25% an additional portion of sorbent is intended to be used after the sensing element.

Build-in cartridge/canister electronic sensor should be capable of withstanding any chemical pretreatments with reagents of the sorption media. The cartridge/canister should be physically shared in two portions: first portion of the cartridge/canister should contain approximately 75-80% of the sorbent, then sensing element, then second buffering portion of the canister having 20-25% of the sorbent, respectively portion of total capacity. Cartridges with build-in sensors have comparably high cost which will completely eliminate one main purpose of the sensor—low cost of indication of depletion of the cartridge to deliver a high safety level.

Thus, there is a need for a system for secure and effective end-of-service life of the indication allowing buffer time and sorptive capacity after less than complete depletion of the sorbent media. There is a further need for a light weight, more easily manufactured, and uncomplicated design for a system and device for end of service life indication.

There is a still further need for a end of service life indication system or method capable of estimating the remaining cartridge life substantially during real time and that allows communication between the user and the system capable of generating warning signals to the user when desired.

SUMMARY

There are currently no effective system for determining the end of service life of a respiratory protection canister. Currently, users merely throw the canisters away after use to avoid risk of exposure to airborne toxins. The consequences of exposure are too high to be uncertain about the capacity of a respiratory protection system. Therefore, many canisters are discarded prior to their depletion of their useful capacity. Embodiments of the remaining service life indication system provide the ability to monitor the use of a respiratory protection system such as a gas mask canister and determine when the capacity of the sorbent in the canister has sufficiently consumed and warn that the canister should be replaced.

Embodiments of the remaining service life indication system for a respirator comprise a respirator body or gas mask comprising a canister attachment portion. A canister comprising a chemical sorbent may be attached to the canister attachment portion to adsorb airborne toxins from the air to be breathed. Further, the remaining service life indication system may comprise a central processing unit, a concentration sensor capable of determining the concentration of at least one chemical compound in air and in communication with the central processing unit, and a gas flow meter capable of measuring the gas flow through the canister and in communication with the central processing unit. The central processing unit and sensors may individually be attached to the respirator body or gas mask, the canister, or may be installed in an area in the vicinity to the wearer of the gas mask. The central processing unit receives input from the concentration sensor and the air flow sensor to estimate a total amount of the at least one chemical compounds that have contacted the sorbent and to determine an approximate remaining service life for the canister and/or the sorbent contained within the canister.

The central processing unit may comprise an internal clock and may be programmable by input means, wherein the input means is at least one of wires, infrared link, radio frequency, blue tooth, personal computer, centralized work station, portable specialized programming modules, digital cell-phone, internet communication, key pad, key board, or mouse. The program may comprise multiple modules including modules for calculation of the remaining life based on the data supplied by said sensors; calibration data and initial capacity data pertaining to canisters in use; and a warning module program for sending signals by visual, audible and/or tactile means.

The canister itself may comprise a computer memory device that is capable of storing and/or recording and communicating the remaining service life of the sorbent in the canister. In such embodiments, the canister can then "report" or communicate its remaining service life to any external device such as a central processing unit or warning indicator, wherein the warning indication may be on the gas mask or at an external location such as a control room. Thus, the user of the canister can be alerted when the remaining service life of the canister falls below a specific level and should be to be replaced shortly. For example, the central processing unit or the warning indication system can alert the user of a respiratory protection system that the canister has only 25%, 20% or 15%, for example, remaining service life of the original capacity of the chemical sorbent and should be replaced. The warning system may be programmed to provide a series of warning indicators that the capacity is being depleted or provide only one warning that replacement is required.

The canister or gas mask may comprise a communication unit capable of communicating with the central processing unit. The communication unit may be a radio frequency identification unit and also comprise a memory. The radio frequency indication unit is capable of communicating with the central processing unit to obtain the total amount of chemical compounds that have contacted the sorbent. Embodiments of the RFID may have an internal memory, and the internal memory is capable of storing information, wherein the information comprises at least one of a type of canister, canister manufacturer's name, canister serial number, canister part number, canister manufacturing date, capacity of the canister for claimed class of contaminants, alarm set points, maximum service concentration levels, a temperature correction factor for the canister, a relative humidity correction factor for the canister, a pressure or altitude correction factor for the canister, an expiration date for the canister, a targeted compound, a class of target compounds, a use date, start time of use of the cartridge, elapsed time of use of the cartridge, or an estimated total amount of target compounds exposed to the canister.

Further embodiments of the remaining service life indication system may further comprise additional sensors. The additional sensors may include, but are not limited to, a temperature sensor 75, a relative humidity sensor 76, a pressure sensor 72 or other sensors. Any or all of the additional sensors may be in communication with the central processing unit.

Further embodiments of the remaining service life indicator may comprise at least one warning indicator providing at least one of a visual warning, an audible warning or a tactile warning. The warning indicators may provide an alert that the remaining service life of a canister is below a prescribed threshold, that the oxygen in the work area is below a certain threshold or that concentration of one or more chemical compounds is greater than a certain threshold.

Embodiments of the remaining service life indication system comprising a central processing unit may be designed such that the central processing unit is in two-way communication with an radio frequency identification unit or other communication device for exchange of data concerning the ambient environment and the remaining service life of the canister. In some cases, the central processing unit is capable of calculating a total contaminant load on the canister and a remaining capacity of the canister from data provided by the sensors and the database or other computer memory device on the canister or on an external device. As such the central processing unit and the canister itself has total amount of contaminant trapped into said cartridge/canister and remaining capacity of sorbent not being depleted or as a percentage of the original capacity for example, and the central processing unit is capable of generating warning information and activating at least one warning indicator to indicate an action based upon the inputs and calculations. The system may further generate a warning signal when the remaining life of the battery is less than 9 hours, therefore the battery should be changed before full working shift. To reduce battery consumption, the battery may be supplemented with auxiliary charging solar-cell device 90 mounted on the outer surface of the mask.

The system in applicable to respirators comprising a half mask face piece, the respirator is a full face piece mask, or an entire or partial protective suit. For use in hazardous areas, certain embodiments of the remaining service life indication system may be intrinsically safety and explosion proof.

The RFID may be initialized by storing data or information that the canister has been put in service and update based upon the service with a remaining life as % of original capacity of a new canister of this type, average concentration during previous use, average time of previous use, and time of first activation and time at the ending of last use are stored in an internal memory of the radio frequency identification unit.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

DESCRIPTION OF THE DRAWINGS

The invention will now be described with the reference to the drawings wherein:

FIG. 1 depicts two embodiments of a half mask each having a different connection between air flow sensor 20; on the inlet side as shown in FIG. 1-A of the canister 30 or on the outlet side as shown in FIG. 1-B of the canister 30;

FIG. 4-B depicts an electronic air flow sensor of thermistor or transistor type;

DESCRIPTION OF THE EMBODIMENTS

Figure 2:
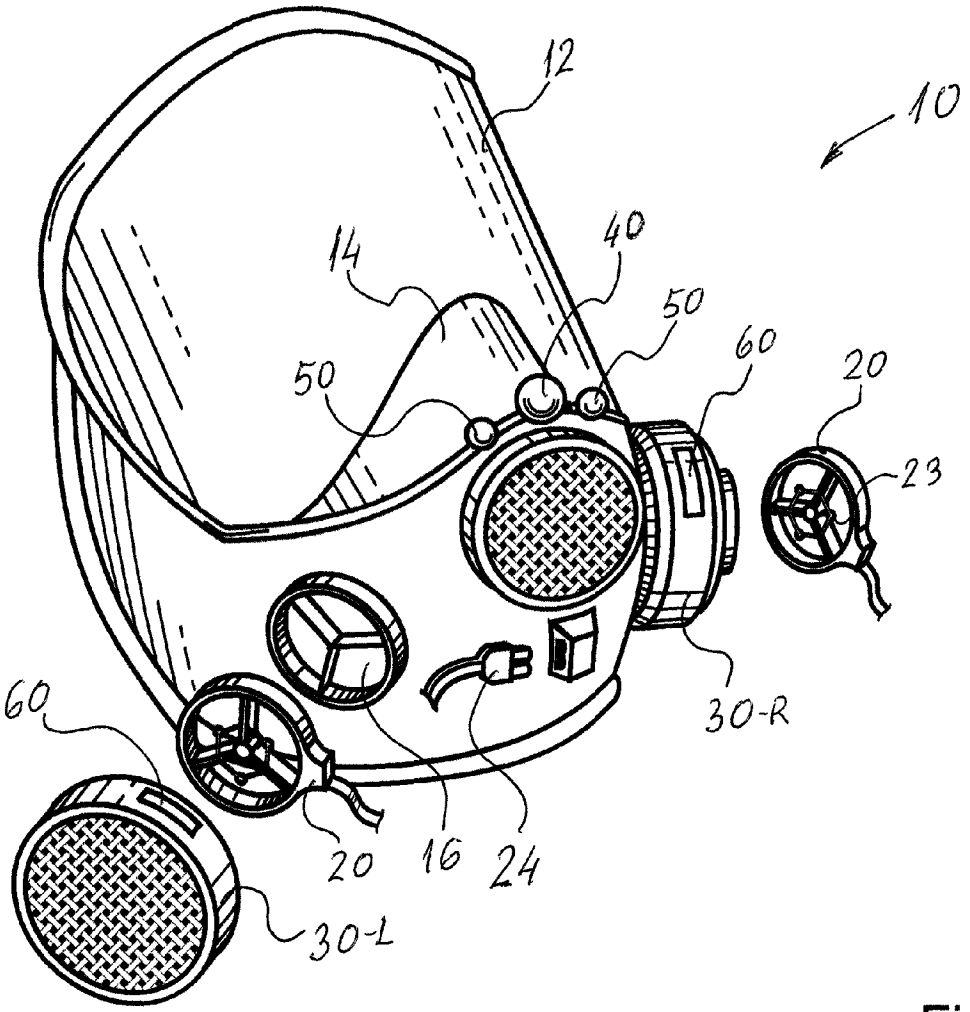
FIG. 2 depicts a full face piece showing two ways for connection air flow sensor 20; on the inlet side 30R or on the outlet side 30L and two ways of placement of the concentration sensor; in front of the cartridge or on the mask

Gas masks are used to protect the respiratory system of people in potentially hazardous environments. The gas mask is a covering that is placed over a wearer's mouth and nose to protect them from inhaling the airborne toxic materials by absorbing or adsorbing the airborne toxins on a filter or chemical sorbent prior to the air entering the user's respiratory system. The airborne toxins may be any potentially dangerous chemical compound such as, but not limited to, airborne chemical pollutants, particulates and/or toxic gases, for example. The airborne toxic materials may be gaseous, suspended in air or particulates, for example.

Gas masks form a seal over the nose and mouth so air must be drawn into the interior volume between the mask and the wearer's face through a canister, cartridge and/or filter comprising the sorbent material, filter media, or other respiratory protective material (hereinafter "canister"). The canister may remove the airborne toxic materials to protect the wearer. A full gas mask may also cover the eyes and other vulnerable soft tissues of the face. Some masks may have one or more canisters attached directly to the face piece while others have a canister connected to the face piece by a hose.

Embodiments of the remaining service indication system for gas mask canisters or the respiratory protection device comprise a chemical sorbent canister, a gas mask capable of receiving the chemical sorbent canister. The gas mask may comprise a central processing unit capable of communicating with the communication module, a chemical concentration sensor in communication with the central processing unit, and an air flow sensor in communication with the central processing unit.

Embodiments of the central processing unit are capable of estimating the amount of target chemical compounds passing into the chemical sorbent canister from an output of the chemical concentration sensor and the air flow sensor. The central processing unit is capable of estimating the amount of target chemical compounds based upon input from the sensors. The chemical concentration sensor is capable of determining a concentration of at least one chemical compound in the sampled air and communicating the concentration to the central processing unit. Similarly, the air flow sensor is capable of measuring the air flow through the canister and communicating the air flow to the central processing unit. From this information, the central processing unit may calculate a total amount of the at least one chemical compound passing through the canister and adsorbed or absorbed in the canister. The total amount of the at least one chemical compound may be calculated by integrating an area under a curve of the chemical concentration multiplied by the air flow versus time. The central processing unit may then calculate a remaining capacity of the canister by subtracting the total amount actually passed through the canister from the total capacity of the canister for those chemical compounds. The accuracy of the calculation is the subject to the accuracy of the sensors, the amount of data generated by the sensors, and the limitations of the memory and the central processing unit.

Each canister has a service life based upon several factors including the type of sorbent in the canister, the total amount of sorbent in the canister, total amount of chemical compounds that pass through the canister, the original manufacturing date of the canister and the environmental conditions of the storage and use of the canister. Embodiments of the canisters have a computer memory device capable of storing and reporting an approximate remaining service life to an external device and prevent overuse of a canister and potential exposure of the gas mask wearer by breakthrough of airborne toxic materials. As such, specific embodiments of the chemical sorbent canister may comprise a chemical sorbent within a canister, a computer memory storage device capable of storing data and communicating digital canister information, and a communication module capable of communicating with an external processing unit. The digital canister information may include, but not limited to, canister identification, specific compounds capable of being absorbed or adsorbed on the sorbent material, the initial capacity of the canister and the remaining service life of the canister, for example. At specific remaining service life, an indication or warning that the canister may be depleted of sorbent capacity and should be changed for a new canister or one that still has sufficient remaining service life capacity.

Embodiments include a canister for use with a respiratory protection device comprising a container, a chemical sorbent within the container, and a digital memory storage device capable of storing and communicating information. As used herein, "canister" means a canister, cartridge, or other apparatus comprising a sorbent respiratory protection media. The canister may comprise a radio frequency identification unit in communication with the computer memory storage device.

Canister

The canister comprises a sorbent material, filter media, or other respiratory protective material. The airborne toxic materials may be adsorbed on the sorbent material, filter media, or other respiratory protective material within the canister as air is drawn through the canister upon inhaling. Absorption or sorption is the process a compound being drawn into a body or substrate and adsorption is the process of deposition of a material upon a surface. The absorption process may work by attractive charges, for example, if the target particles are positively charged, use a negatively charged substrate. Examples of substrates for absorption media include activated carbon, and zeolites. Activated carbon is a common component of gas masks due to its extremely high surface area for adsorption of a variety of pollutants from air. Pollutants may not react with the carbon but may adsorbed into the pores or react with functionalized sites on the carbon.

The sorption media will generally comprise a physically adsorption, a reactive substance or active sites. The active sites may comprise functional groups that exhibit different properties and may be used to absorb different compounds. Thus a media can be tailored to a particular toxic group, substance or class of substances. For example, when the reactive substance comes in contact with the media, it will bond to it, removing the substance from the air stream.

However, the protection provided by the sorption media in the canister will be depleted by use. Filters will clog up, substrates for absorption reach their capacity, and reactive filters will run out of reactive functional groups. The user of a gas mask comprising a canister will only have protection for a limited time, and then he must either replace the canister in the mask.

Central Processing Unit

The gas mask and/or canister may comprise a central processing unit capable of calculating the remaining service life of the canister and issue a warning as the canister capacity to absorb or adsorb further compounds is diminished. As used herein, a central processing unit (CPU) is a portion of a computer system that carries out the instructions of a computer program and performs the basic arithmetical, logical, and input/output operations of the system. The term central processing unit also includes both distributed processing systems and multiple central processing units.

Embodiments of the remaining service life indication system comprise electronic means such as central processing unit (CPU) capable to integrate air flow over given time period and to multiply the integrated air flow to integrated data for concentration for the same given period of time, thereby calculating the total amount of contaminant carried by the air flow for this time period. In embodiments of the remaining service life system comprises an airflow sensor positioned to measure the air flow through a respiratory protection canister and a chemical concentration sensor that can approximate the concentration of compounds in the air surrounding the gas mask. With input from these sensors, the central processing unit may calculate an approximate the total amount of contaminants passed by air flow through cartridge/canister for given time. The systems, gas masks, containers, and methods provide a first approach to approximate the real load on the cartridge/canister. This load on the canister can be used to provide a warning signal to the user of the respiratory protection system. Embodiments of the warning signal may include visual, audible and/or tactile devices for producing the warning signals.

Embodiments of the remaining service life indication system can provide satisfactory data and reliable information for most of the common cases. Such embodiments of the remaining service life indication system may provide a reliable warning of the remaining canister capacity for providing respiratory protection. The remaining service life indication systems may provide an indication that the canister protection capacity is nearly depleted and a warning the user to replace the canister.

One method of determining the total load on a sorbent material within a canister and the remaining service life of the sorbent is provided below. A central processing unit can estimate a total amount of airborne contaminants for any period of elapsed time from the value of the concentration output from the concentration sensor and the value of the air flow from the air flow sensor. This data can be further integrated and for any passed period of time the total mass of contaminant passed through the system will be known:

$$M=Cdc/dt\times Fdf/dt \quad (1)$$

Where

M—mass of contaminant in (mg)

C—concentration in ($mg/m^3$)

F—air flow in liters per minute (LPM)

dc/dt—function of concentration over time df/dt—function of air flow over time t—time (min).

The equation (1) can be simplified by introducing the averaged values for the two parameters C and F:

$$M=C\cdot F\cdot T \quad (2)$$

Where:

M—total mass collected into cartridge

T—Elapsed time (min).

Additional embodiments of the remaining service life indication system may comprise compensation factors for the calculation of the mass of adsorbed contaminant for humidity, temperature and barometric pressure:

$$M=C\cdot F\cdot T\cdot Kt\cdot Kr\cdot Kp \quad (3)$$

Where:

Kt—temperature correction factor, specific for given adsorbent

Kr—Relative humidity correction factor specific for given adsorbent; and

Kp—Correction factor for barometric pressure.

The correction factors for temperature and relative humidity may be approximated or provided by the canister manufacturer. The correction factor for pressure (latitude) Kp may be, for example, as follows:

$$Kp = \frac{1013\ \text{hPa}}{\text{Actual atmospheric pressure at measured place (hectopascal, hPa)}}$$

Embodiments of the remaining service life indication system may comprise all or part of the following components:

Sensor devices capable of providing information about ambient concentration of the targeted contaminants.

On the base of these two parameters—concentration and air flow the third important part of the invention—CPU can calculate at any moment the mass flow (m*) and having total time for a given moment can integrate the total collected mass (M) as well as total exposure dose in (parts per million hour) ppm·h or mg/m3·hr. These data can be additionally depicted latter in appropriate display.

Warning Indicators

Once transferred the information for ongoing exposure dose is compared to the information for predetermined capacity of the cartridge/canister at the preset level 75-80% of total capacity. CPU is generating alarming signals for three different alarming means—visual, sound and vibration. Those signals are transferred to a fourth part of the invention—warning/alarming signals system. Visual warning should be provided by Light Emitting Diode (LED)—orange color suggested at the moment of 75% and red for the moment over 80%. Same red color LED should warn for concentrations over limitations for sorption type equipment (2% by volume contaminant). Sound warning device should have intensity of at least 85 db and giving short (e.g. 0.1 to 1 sec.) and long (e.g. 2 to 5 sec.) impulses respectively for 75% and 80% depletion. At 80% build-in vibrating system in the gas mask should warn for this level also. After the first and even after the second signal the cartridge should have enough capacity to keep the user in safety conditions for some period of time when the user has to go out of the contaminated zone and safely to change the canister/cartridge. The CPU shell incorporate internal electronic clock thereby to integrate all signals received from the sensors as a parameters changed in real time.

The respirator CPU shell incorporates a link device for communication with authorized devices. Such devices are including programming means, side interrogation and checking devices and remotely situated receiver(s) allowing tracking the user on the work field. The technology could be hard wired, infrared, radio frequency, blue tooth.

Memory

In embodiments of the container, the digital memory storage device is capable of being written to and read by a digital processing unit such as a central processing unit. As used herein, computer memory refers to the physical devices used to store programs and/or data on a temporary or permanent basis for use in a computer or other digital electronic device. The computer memory storage device may be at least one of RAM, DRAM, SRAM, tape, magnetic disk, optical disks, flash memory, compact disk, DVD, and/or addressable semiconductor memory. A portion of the memory may be read only memory for storing information concerning the canister or gas mask that is more permanent such as, but not limited to, the canister identification, the chemical sorbent in the canister, the compounds capable of being absorbed or adsorbed on the chemical sorbent, the amount of chemical sorbent in the canister, the general capacity of the chemical sorbent, the capacity of the chemical sorbent for a specific target compound, the date of the manufacture of the canister, and/or the expiration date of the canister, for example. Other digital memory may be read/write memory. The term "memory" is often associated with addressable semiconductor memory, i.e. integrated circuits consisting of silicon-based transistors, used for example as primary memory but also other purposes in computers and other digital electronic devices.

The computer memory storage device is capable of storing canister information including, but not limited to, a canister identification indicator, an initial sorbent capacity, and a remaining sorbent capacity of the chemical sorbent. The gas mask may further comprise a second computer memory storage device, and the second computer memory storage device is capable of storing a additional canister information including, but not limited to, canister identification indicator, an initial sorbent capacity, and a remaining sorbent capacity of the chemical sorbent.

In other embodiments, at least a portion of the canister information may be stored on an external computer memory device. In such embodiments, the central processing unit may communicate through a wifi network to an external computer network for storing at least the remaining service life capacity of the canister. In such embodiment, it may be advantageous to use the entire capacity of the canister with the same gas mask.

Chemical Concentration Sensor

Sensors are integral to many environmental monitoring systems. There are conventional electronic or optic-electronic sensors for variety of chemical contaminants for which respirators are used to protect their wearers. There are also a variety of metal oxide sensors for variety of classes of contaminants. Both of those types of sensors and also some others are capable to deliver electronically data for their ambient concentration at any time to electronic processing unit.

Any type or model of chemical concentration sensor may be used in embodiments of the system. A preferred sensor has the desired sensitivity, range laps time (time of reaction) and provides concentration independent of the ambient temperature and humidity. In certain embodiments, the sensitivity of the sensor should include concentrations down to Permissible Exposure Limits (PEL's)—Time Weighted average (TWA) or Threshold Limit Value (TLV); the time of reaction should be small—less than 1 minute; and/or the sensor output should be independent of relative humidity and temperature or the sensor or central processing unit may provide electronic correction for these parameters.

The output of the sensor should be directly or indirectly communicated to the central processing unit. The signals may be analog or digital depend on interface of the sensor and the central processing unit. The sensor should be capable to accept and transmit information for specific contaminants. The central processing unit processes the information from the sensor and may determine the concentration from calibration data.

The central processing unit may also generate an additional warning if the output of the chemical concentration sensor provides a signal that the ambient concentration of compound exceeds specified limited established for (and enforced) for sorption type equipment currently being used in the respiratory protection system. In further embodiments, the sensors may be interchangeable for different targeted contaminants. Further, the concentration sensor may be disposable and removably mounted on the canister. The concentration sensor may be applicable to a specific canister and may be sold together. In other embodiments, the concentration sensor may be reusable.

Airflow Sensor

Conventional dynamic flow sensors are capable of estimating the air flow through the cartridge/canister at any time and communicate the data for air flow at any given moment to central processing unit. The air sensor may be mounted in front of the cartridge/canister inlet, in the air flow path, or at the air outlet of the respiratory protection system. The air flow sensor provides information about the air flow through the canister and may transmit a digital or analog signal to the central processing unit. Typically, an air flow sensor function by determining an average air velocity through a channel with a known cross-sectional area to determine the volumetric flow. The air flow sensor may assume the volumetric flow has a similar density to air and convert the volumetric flow to mass flow rate. In other embodiments, the air flow sensor output may be corrected for ambient conditions such as, but not limited to, temperature, relative humidity, and/or barometric pressure.

There are a variety of conventional air flow sensors for measuring air flow velocity or volume. Two of them are shown for illustration (although the invention is not limited to only those two types). First type is optic-electromechanical and is described as closely related to vane or turbine type anemometer as shown in FIG. 4-A. Such sensor has a propeller or fan 26 and emitting/receiving photo-resistors 22 preferably mounted in the same body-jacket, or LED light source and photocell coupled to count light reflections or light breakages from the vanes of the propeller. Reflected light is pulsing and the number (count) of those reflections or breakages is with frequency directly proportional to the air flow. The electrical signals as a pulsing current may be provided to the central processing unit via cable with connecting plugs 24 or wirelessly.

Another type of air flow sensor is a thermo-anemometer type of air flow sensor and temperature. Multiple temperature sensors, thermistors 23, are situated symmetrically in the most equalized cross section of the air flow.

Environmental Sensors

The ambient conditions such as, but not limited to, temperature, relative humidity and the barometric pressure may optionally also be measured by sensors and communicated to the central processing unit or other sensors in the system. These environmental sensors may be located on the canister, gas mask or external to the respiratory system. The ambient temperature, relative humidity, and barometric pressure may affect the absorption and adsorption capacity of the sorbent media and affect the calculations for determining the total amount of chemical compounds that pass through the canister. The information output from the sensors, air flow and chemical concentration, may be corrected by the output of such sensors specific to the given sorbent in the cartridge/canister.

For example, at over 85% relative humidity (RH) the capacity of charcoal, one of the best and most widely used sorbents, is reduced significantly. The capacity of the sorbent may also be reduced by elevated temperatures in some cases. In certain embodiments, the computer memory device of the canister will include correction factors for the sorbent in the container. The correction factors for temperature, relative humidity, barometric pressure and/or other environmental factors will be communicated to the central processing unit along with calibration and capacity information for certain canister used for certain class contaminants. The output from the environmental sensors may be communicated to the CPU for generating appropriate correction factors for estimating and reporting the remaining service life of the canister.

Oxygen Sensor

Optionally the canister, gas mask, respiratory protection system, and remaining service life system may comprise an oxygen sensor 81. The oxygen sensor 81 may communicate the oxygen concentration to the central processing unit to alarm if the oxygen concentration drops toward an unsafe concentration.

In embodiments of the remaining service life system, the sensors may provide a continuous output or signal to the central processing unit. In other embodiments, one or more of the sensors may provide an intermittent output or signal to the central processing unit. The intermittent signal may be provided to the central processing unit at regular intervals such as, but not limited to, every 30 seconds, every minute, every five minutes, for example. In still further embodiments, the at least one sensor may not provide any output to the central processing unit unless a certain threshold value is reached.

Communication

In embodiments of the remaining service life indication system, the canister may comprise a memory device that allows the canister to be labeled with an indication, such as a database entry or other data storage in a computer memory device, of the amount of the sorbent in the canister has been consumed and/or the remaining service life capacity of the sorbent that is still available. In embodiments of the remaining service life indication system, the gas mask comprises a central processing unit that may communicate with the computer memory device on the canister. The central processing unit may communicate with the computer memory device to "label" the canister as previously used and provide an indication of the remaining service life. In this way, the canister may be used on multiple gas masks during its service life and still maintain an indication of the remaining service life that may then be further updated based upon additional use.

The central processing unit may communicate with the computer memory device through any communication means. For example, the central processing unit may communicate with the memory device through a communication module by a wired connection. The canister and the gas mask may comprise a plug and socket connection or any other wired connection, for example.

In additional embodiments, the remaining service life indication system for a respiratory protection device may comprise a central processing unit capable of communicating with the communication module of the memory device through a wireless connection. The wireless connection may be a radio frequency identification unit, a blue tooth connection, wifi connection, or other wireless communication, for example. In embodiments wherein the communication is through a radio frequency identification unit the radio frequency identification unit may be one of an active radio frequency identification unit or a passive radio frequency identification unit.

The computer memory device on the canister may be able to report the stored information to an external central processing unit or other digital processing device. Inseparable part of the invention is a memory—Random Access Memory (RAM-type) of the CPU collecting and storing calibration data for capacity of the cartridge/canister. The CPU (memory) can keep a library of those data and should allow introduction of new data for any new type of cartridge/canister or any new application—new contaminant. This important data is transported to the CPU via cable connector, bar-coded information with optical bar-code reader, key-card, coded electric contacts (by shape) or by RFID communicator—part of the CPU unit. The data for any newly connected canister/cartridge should be introduced by one of aforementioned ways.

In case where data are stored in RFID unit mounted on the surface or inside of the cartridge/canister the system CPU interrogates the RFID for all range of initial data and communicates to RFID recent information for all elapsed time. The memory of RFID unit is not necessary to be high and the cost of this unit should be significantly small allowing the RFID to be disposable or the RFID unit to be interchangeable and to be reprogrammed.

The way of introducing this information should allow CPU to use complete data about calibration curve for certain contaminant, which can be stored in memory—library of the contaminants vs. capacity. The required volume of such library capacity is relatively low, expected to be in units of kilobits.

The data for the cartridge/canister calibration, correction coefficients for temperature, relative humidity and barometric pressure can be introduced by different ways:

Bar code and portable reader reading the bar-code directly attached to the outer cartridge surface and transferring data to the CPU;

Electric Key—arrangement of electric contacts under special scheme in order to switch CPU to certain calibration mode already introduced in its memory. The electric key can be directly attached to the surface of the cartridge which is mounted to the socket on the face piece;

Wireless by use of Radio Frequency Identification (RFID) build-in or attached on the surface of the cartridge/canister and communicating by appropriate means with the CPU of the system.

RFID may contain information for:

Type of equipment—canister, cartridge, filter or combination

Manufacturer's name/Serial number

Part number

Manufacturing date

Capacity for claimed class of contaminants in mg adsorbed to 85% capacity and 100% capacity Breakthrough moment at different concentration levels if necessary Temperature correction factor Relative Humidity correction factor Pressure/altitude correction factor Alarm set points Expiration date Once introduced (mounted on the gas mask) RFID may additionally be loaded with:

The name of the targeted analyte

For each period of use date and start time when put in use, end of elapsed time and total mass—M contaminant charged during this session Purchaser's part number of designator Remaining useful life at the start ambient condition A password or code allowing communication only with an authorized devices Other specific information.

RFID communicates bilaterally this data with CPU such way that the data can be retrieved and displayed at any moment on:

Portable build in display

Separate display in communication with CPU

Build in mask micro-display.

Once the data for total mass of contaminants passed by air flow through the respirator are known, they can be compared to the data of real capacity of such cartridge/canister established during preliminary calibration studies.

The RFID chip in the respirator would be notified of the start time by button or build-in pressure sensor-switch and remain activated during all time of use, receiving relevant information from CPU and storing it in the memory.

As RFID chip is in continuing communication for all elapsed time of use at the end of this time CPU will copy and transfer to RFID's memory all information for the elapsed time period including but not limited to:

(a) Total mass M of contaminant trapped into cartridge/canister or filter (b) Remaining life as % of initial (c) Data for all ambient conditions during elapsed time.

After each new use or after eventual transfer of the cartridge to another gas mask the CPU will interrogate RFID, accept the information and integrate newly received exposure to the old data, keeping record for all previous usages of cartridge/canister RFID and eventually estimating possible "creeping" of the contaminant during long periods when cartridge is not in use.

Embodiments of the communication module and the computer memory storage device are part of a radio frequency identification unit.

Embodiments of the remaining service life indicator system are shown in FIGS. 1-A and 1-B. FIG. 1-A and FIG. 1-B depict a half gas mask assembly 10 that can accommodate two canisters, one on either side of the mask (for the sake of clarity, only one side is shown in the figures.). Concentration sensor 40 may be mounted on the inlet of the gas canister/cartridge 30 together with the air flow sensor 20 as shown in FIG. 1-A. In other embodiments, for technological and convenience, the concentration sensor 40 can be attached to the mask 14 as shown in FIG. 1-B. The concentration sensor may be located in close proximity to the air inlet on the canister as shown in FIG. 1-B. Concentration sensor 40 can be assembled in even more remote area of the mask or not on the mask but measuring the ambient conditions of the area in which the gas mask is being used and reporting to the central processing unit for calculation of a load on the sorbent in the canister 30. Further embodiments are not shown in the figures, but the sensor 40 may be positioned on the shoulder, front of the shoulder, lapel of the garments, on the rim of the hat, as well as elsewhere on the user or in the vicinity of the user. The signal from the concentration sensor 40 may be used as a base for continuous monitoring of the ambient concentration of the contaminants of interest. The signal from sensor 40 can be processed also separately and displayed on a screen such as a Liquid Crystal Display (LCD), for example, in a convenient location for visual observation from output from the system's central processing unit or directly from the sensor. In particular cases, sensor 40 can be part of existing gas analyzing device-monitor, given such sensor can deliver continuous monitoring data to the mask's CPU via wired or wireless communication.

In the embodiments shown in FIGS. 1-A and 1-B, an RFID unit 60 is mounted on the surface of the cartridge/canister 30. In other embodiments, the RFID unit or other communication device may be located internal to the canister.

Warning indication lights 50 may be placed in an area visible to the user, typically, in top front part of the mask as shown in FIG. 1-A and two symmetrical lights close to the eyes on FIG. 1-B. Embodiments of the remaining service life indication system may also comprise vibration indication means 52.

Figure 3:
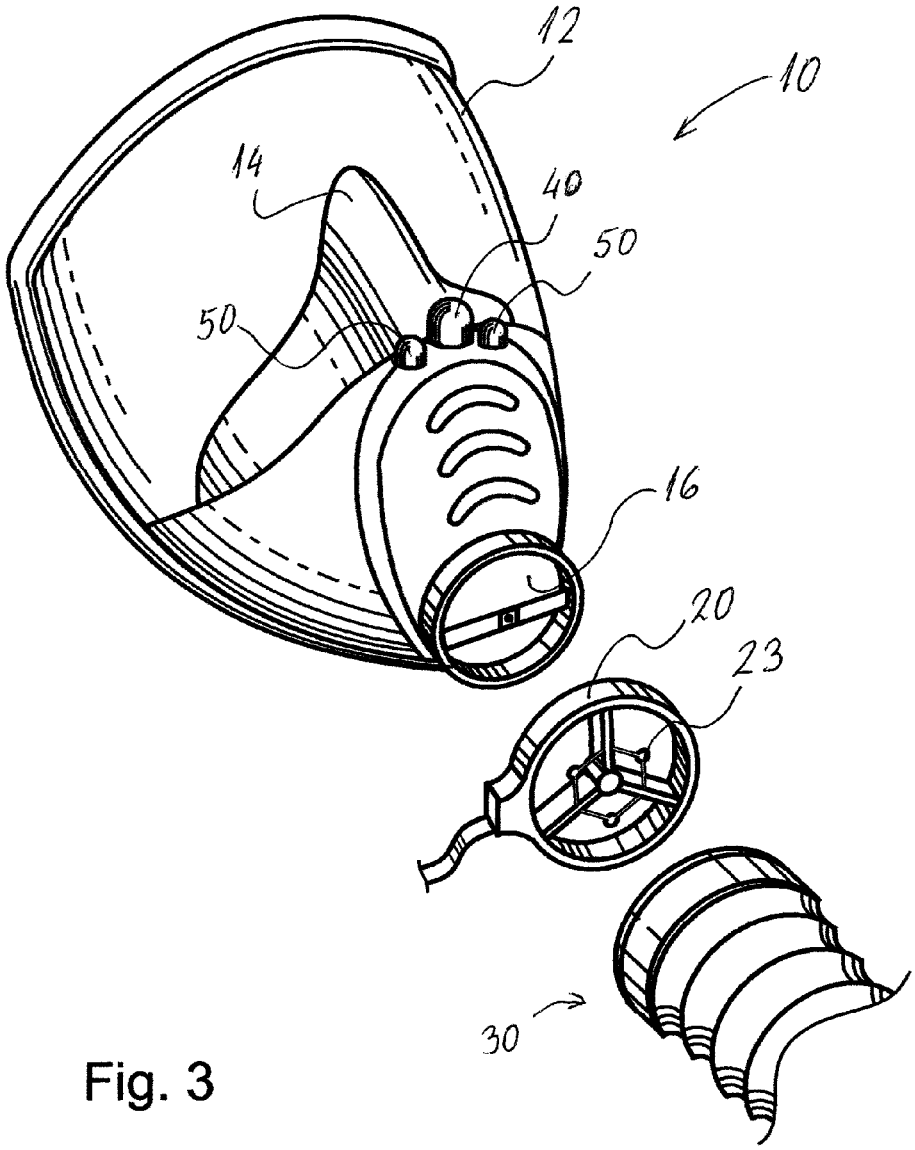
FIG. 3 depicts a full face piece mask with air flow sensor 20 in front of the canister 30 and concentration sensor 40 on the mask FIG. 4-A depicts a front view and cross-sectional view of a fan-type air flow sensor.

When canister is connected to the face piece with flexible fluid flow connection and same canister is placed on the belt or on the back of the user the placement of the air flow sensor 20 may have the similar accuracy and reliability on the inlet of the canister or on the inlet of the face piece as shown on FIG. 3. The placement of the concentration sensor 40 may be in similar locations. The two preferred locations of the sensor 20 and sensor 40 shown on FIG. 1-A and FIG. 1-B have their pros and cons. The placement of air flow sensor 20 on the inlet part has advantage of keeping the dead volume between front portion of the sorbent bed and one direction suction valve (check valve not shown on the schematics) very small. Placement of air velocity sensing fixture 20 on the outlet side of the cartridge has advantage that the sensor will less likely be contaminated by any active gases, aerosols, dust etc. but the dead volume may be a little bigger.

The embodiments of the cartridge canister 30-L and 30-R on FIG. 2 are shown to depict the placements of the sensors 20 and 40 in the face mask. The warning signal lights 50 and the vibration means 52 may be situated on one or both sides of the mask. For example, light emitting diode 50 on the outer surface of face mask and vibration means 52 (shown on FIG. 1) on the inner surface of the face piece 14. In the embodiment of FIGS. 1-A and 1-B, vibration device 52 is placed inside the mask and close to sensitive points on the cheeks so the warning indication may easily be sensed.

The embodiment of shown on FIG. 3 illustrates the use of a canister with a connector hose 30. In such embodiments, placement of the canister can be on the back of the user, on the side of the belt or in a special holster (not shown here). Air flow sensor 20 may be placed directly on the inlet part of the face piece and connected electrically or wirelessly to the central processing unit. Concentration sensor 40 may be placed in front of the nose portion of the mask surrounded by two warning lights 50 in the well visible front part of the mask. Sound and vibration means 52 may be position inside the mask, preferably positioned close to sensitive points of the skin of the cheeks.

On FIG. 4-B is shown thermo-anemometer type of air flow sensor. Three temperature sensors, termistors 23, are situated symmetrically in the most equalized cross section of the air flow. The other sensors are coupled in Winston bridges and are mounted into central beams-support 28. The size of the sensors shown on FIG. 4-B and the fan vanes 26 shown on FIG. 4-A should not affect the air flow more than 1-3%.

Figure 5:
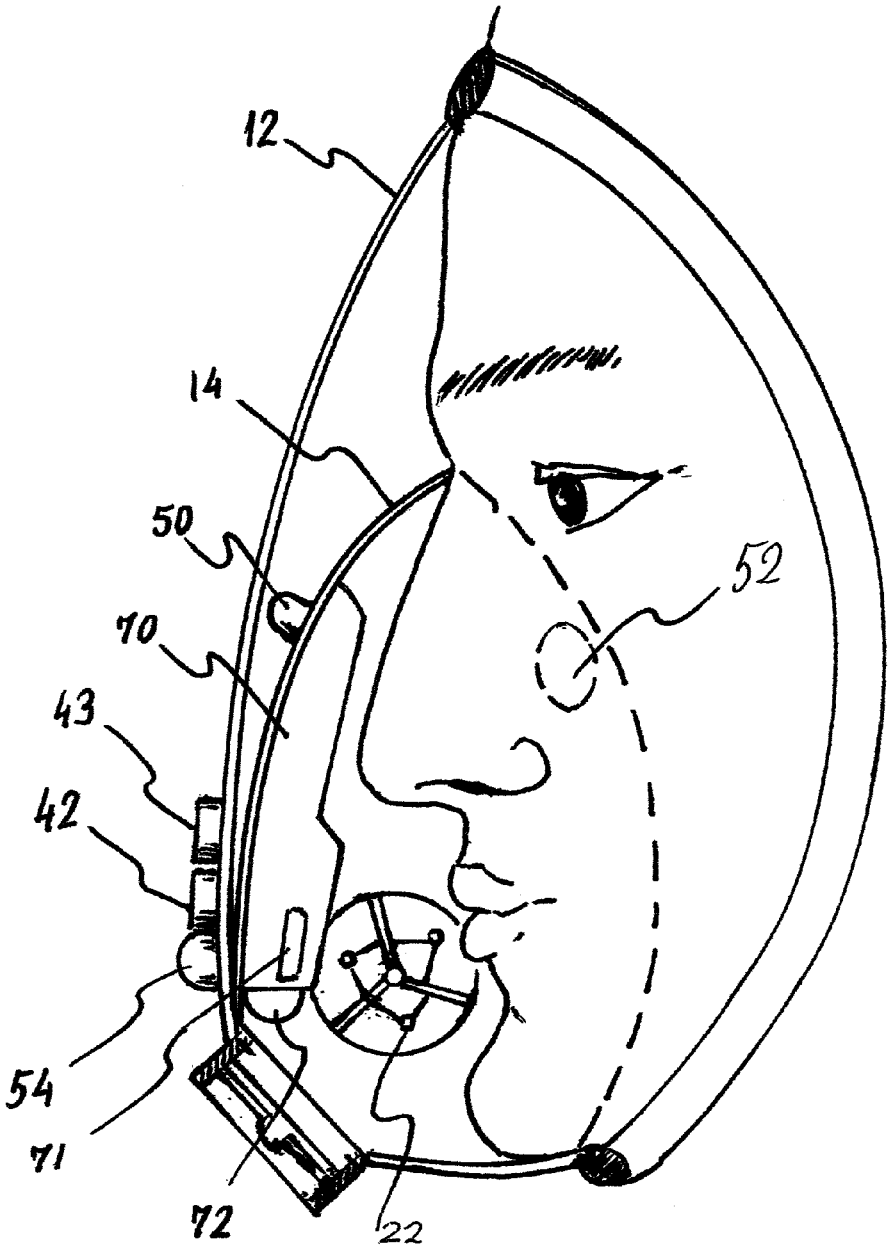
FIG. 5 depicts a half mask or internal half mask cross-section showing potential locations for a central processing unit and an energy supply.

FIG. 5 depicts a cross sectional view of the face piece showing possible placement of microelectronics 70 and/or the central processing unit and its power supply, which is preferably a rechargeable battery 77. The depletion of the power supply may be indicated on the warning indicators, for example, a low battery state may be indicated by frequent flashes of the warning lights: for example two consecutive lasting 0.5 seconds within 0.5 sec. interval orange flashes (for example every 5 min.).

The battery should be well charged and checked at the beginning of use (shift). If at the beginning of use battery the central processing unit indicates battery life less than full working shift, the remaining service life system may generate a warning signal and the battery should be replaced with freshly charged one.

When at the end of service life of canister/cartridge or if the concentration exceeds certain threshold depletion (80-85%) the red warning light should begin flashing in shorter than 0.5 min intervals. This will inform user of the necessity to change the cartridge/canister. When the ambient concentration of a toxic contaminant exceeds a programmed threshold, such as 2% of the ambient air, according to enforced safety legislation, the system warns of the immediate danger.

Figure 6:
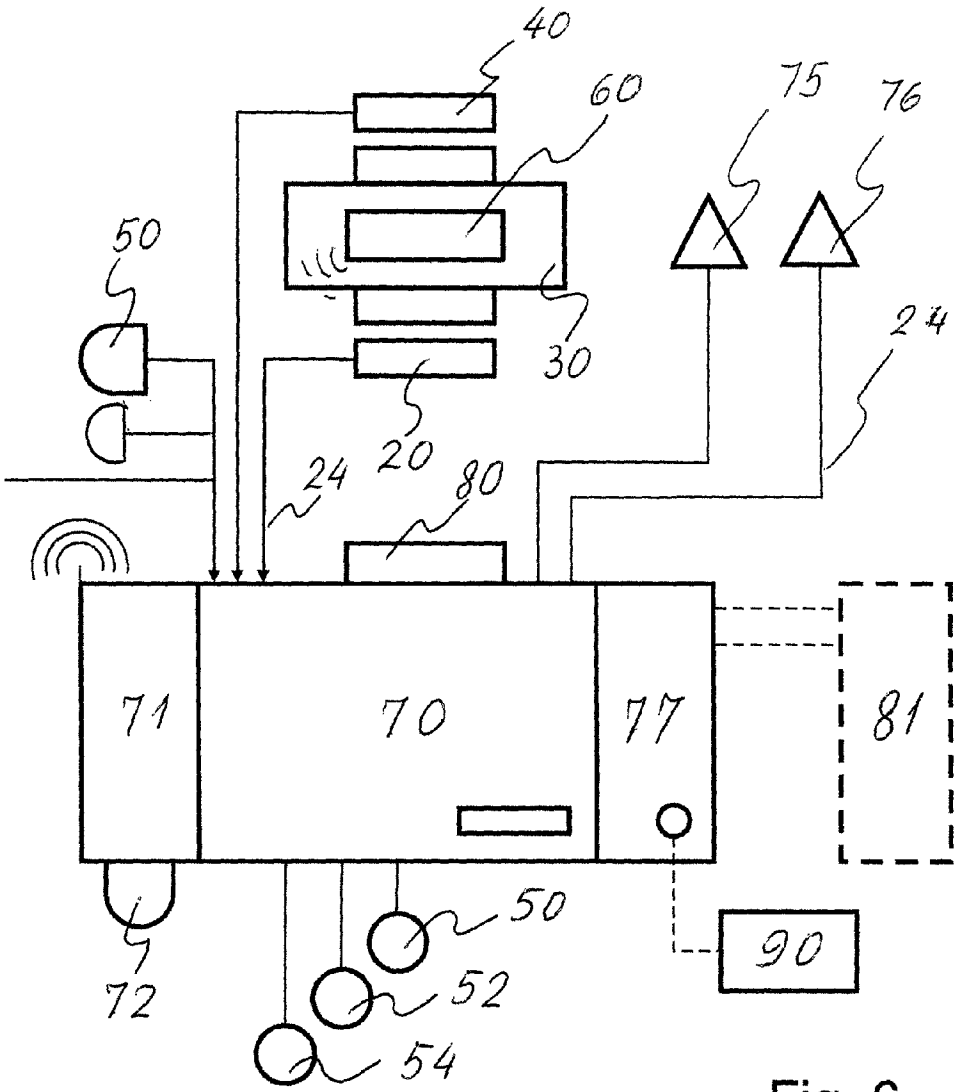
FIG. 6 is a schematic of the communication between a central processing unit, sensors and warning means.

Functional schematic of an embodiment of an active type remaining service life system communicative system is depicted in FIG. 6 where all wire and wireless interconnection 71 are shown along with interconnection of central processing unit with warning devices—visible signal devices 50 (orange and red LED), vibration/tactile devices 52, audible warning devices 54 and interconnection with all sensors. The interconnection between the CPU unit and RFID is wireless, therefore it is possible for CPU to interrogate changed cartridge immediately after it is mounted and pressure switch 72 starts the system.

Embodiments of the remaining service life indication system measures actual concentration, actual breathing air flow volume and real time of exposure, therefore the system is capable to estimate the residual life of the cartridge/canister. Further embodiments may include a system that corrects for the influence of temperature and relative humidity. Further embodiments comprise a remaining service life indication system comprises an RFID on the canister that communicates with a central processing unit to store and record the previous exposure dose and remaining life capacity. The cartridge/canister therefore can be interchanged and the new cartridge/canister will be capable of accessing its memory and report the remaining life capacity of the new canister to allow efficient use of the canister and still provide effective protection to the wearer.

Fourth feature is that the system measures simultaneously the oxygen level and the concentration of contaminant and will warn the user by three unambiguous ways in case of any deviation from the safety standards for those two safety parameters.

Fifth feature is that the system allows all data from any sensor to be also visualized: RH, T, Moment concentration, remaining safety time etc.

The embodiments of the described respiratory protection systems, gas masks, and canisters are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A respiratory protection system, comprising:

a gas mask defining a inner volume, wherein the gas mask comprises remaining service life indicator system comprising:

a central processing unit capable of calculating a remaining capacity of the chemical sorbent canister;

a mount for interchangeably and selectively receiving one of a plurality of different chemical sorbent canisters, wherein the plurality of different chemical sorbent canisters comprise chemical sorbent canisters for removing different airborne targeted contaminants and a computer memory storage device capable of storing canister data information and communicating the canister information and communicating with the central processing unit, wherein the canister data comprises information identifying the airborne targeted contaminant;

a mount for interchangeably and selectively receiving one of a plurality of different chemical concentration sensors, wherein the different chemical concentration sensors comprise sensors for the determining the airborne concentration of different airborne targeted contaminants and are matched to a specific chemical sorbent canister of the plurality of different chemical sorbent canisters and the chemical concentration sensor received in the mount is in communication with the central processing unit;

an air flow sensor in communication with the central processing unit;

a temperature sensor in communication with the central processing unit, wherein the canister data information comprises a temperature compensation factor for the chemical sorbent and the central processing unit calculates the remaining capacity of the chemical sorbent canister based upon the temperature compensation factor, an output from the air flow sensor and the chemical concentration sensor.

2. The respiratory protection system of claim 1, wherein the gas mask comprises a relative humidity sensor in communication with the central processing unit, wherein the central processing unit calculates the remaining capacity of the chemical sorbent canister based upon a relative humidity compensation factor and the canister information comprises the relative humidity compensation factor for the chemical sorbent.

3. The respiratory protection system of claim 2, wherein the gas mask comprises a barometric pressure sensor in communication with the central processing unit, wherein the central processing unit calculates the remaining capacity of the chemical sorbent canister based upon a barometric pressure compensation factor for the chemical sorbent and the canister information comprises the barometric pressure compensation factor for the chemical sorbent.

4. The respiratory protection system of claim 1, comprising a particulate filter upstream of the canister such that air passes through the particulate filter prior to entering the canister.

5. The respiratory protection system of claim 4, wherein the chemical concentration sensor is located in a confined space between the particulate filter and the canister.

6. The respiratory protection system of claim 1, wherein the gas mask comprises alarms on a face mask.

7. The respiratory protection system of claim 6, wherein the alarms comprise a vibration alarm on an inner surface of the gas mask.

8. The respiratory protection system of claim 1, wherein the gas mask comprises an oxygen sensor.

9. The respiratory protection system of claim 1, wherein the gas mask comprises three temperature sensors situated symmetrically in a cross section of the air flow.

10. The respiratory protection system of claim 6, wherein the canister information comprises a targeted compound concentration limit for the canister and the alarm is activated if the concentration sensor indicates a concentration of the targeted compound above the concentration limit.

11. The respiratory protection system of claim 1, wherein the concentration sensor mount is on a front of a nose portion of the mask surrounded by two warning lights.

12. The respiratory protection system of claim 1, wherein the chemical sorbent is capable of absorbing volatile organic compounds.

13. The respiratory protection system of claim 1, wherein the canister information comprises an initial sorbent capacity and a remaining sorbent capacity of the chemical sorbent.

14. The respiratory protection system of claim 1, comprising a battery to provide power to the system and generate a warning signal when the remaining life of the battery is less than 9 hours.

15. The respiratory protection system of claim 1, comprising vibration means positioned such that the vibration means will be close to sensitive points of the skin of the cheeks of a wearer of the gas mask.

16. The respiratory protection system of claim 1, wherein the system displays a remaining safety time for the canister.

17. The respiratory protection system of claim 1, comprising a pressure switch within the inner volume, wherein the pressure switch starts the system.

* * * * *